United States Patent [19]

Ingeberg

[11] 4,389,830

[45] Jun. 28, 1983

[54] ANCHORAGE WITH ACCESSORIES FOR ATTACHMENT TO WALLS, FLOORS AND CEILINGS

[76] Inventor: Bjørn Ingeberg, Skigardveien 6, Oslo 6, Norway

[21] Appl. No.: 230,950

[22] PCT Filed: May 14, 1980

[86] PCT No.: PCT/NO80/00017

§ 371 Date: Jan. 16, 1981

§ 102(e) Date: Jan. 9, 1981

[87] PCT Pub. No.: WO80/02579

PCT Pub. Date: Nov. 27, 1980

[30] Foreign Application Priority Data

May 16, 1979 [NO] Norway ..... 791632

[51] Int. Cl.[3] ..... E04B 1/40

[52] U.S. Cl. ..... 52/710; 52/712; 52/379

[58] Field of Search ..... 52/710, 712, 378, 379, 52/428, 509, 568, 698

[56] References Cited

U.S. PATENT DOCUMENTS

| | | | |
|---|---|---|---|
| 950,771 | 3/1910 | Lohmann | 52/710 |
| 1,470,727 | 10/1923 | Hall | 52/710 X |
| 1,756,174 | 4/1930 | Bosco | 52/710 |
| 1,848,949 | 3/1932 | Halden | 52/710 |
| 2,699,312 | 1/1955 | Di Cesare | 52/712 |
| 2,909,054 | 10/1959 | Phillips | 52/710 |
| 3,114,220 | 12/1963 | Maddox et al. | 52/710 X |
| 3,430,912 | 3/1969 | Davis et al. | 52/712 |
| 3,918,224 | 11/1975 | Sundequist | 52/710 X |
| 4,315,393 | 2/1982 | Schack et al. | 52/710 |

*Primary Examiner*—J. Karl Bell

*Attorney, Agent, or Firm*—Larson and Taylor

[57] ABSTRACT

An anchorage for attachment of ties to walls, floors and ceilings of various kinds, e.g. for attachment of a facing to a concrete wall, consists of a tubular aluminum section (1) having a longitudinal slot for introduction of one end (6) of the tie (5). The slot of the section is provided with edge portions (4) which are curved outwardly so that their end portions extend about tangentially with respect to the cross section of the section. At the opposite side of the slot the section is provided with attachment flanges (2).

The tie (5) consists of a cold-drawn stainless steel wire which at one end is looped to an eye (6), the free end (14) of which being bent transversally and extending some distance outwardly in order to prevent twisting of the tie in the anchorage section. The other end is provided with a transverse portion for securing in mortar or for cooperation with a safeguarding plate (12). The safeguarding plate has two holes (13) which the stem portion and free end portion (11) of the tie may be threaded through in order to prevent relative motion between the safeguarding plate and the tie.

7 Claims, 10 Drawing Figures

ANCHORAGE WITH ACCESSORIES FOR ATTACHMENT TO WALLS, FLOORS AND CEILINGS

The present invention relates to an anchorage for attachment of ties to walls, floors and ceilings of various kinds, comprising a generally tubular section having a longitudinal slot for introduction of one end of the tie. The invention also relates to a tie to be used together with said anchorage, which tie is generally formed of steel wire and has an intermediate, straight stem portion which at one end has a generally circular portion with a diameter substantially equal to the internal diameter of the section, and which at the other end has a transverse portion.

Previously known masonry anchorages of this type necessarily had to be cast relatively deep into the concrete in order for the tie not to be pulled out of the concrete at a certain tensile force. In order to gain access to the cavity of the anchorage section after the casting, it has been usual to place a wooden wedge in the slot of the section and let it extend out to the outside of the concrete. This wedge must later be removed before the tie can be placed in the anchorage. Positioning and removal of the wedge is time consuming and, furthermore, has the disadvantage that only that portion of the anchorage in which the wedge is placed can be used for introduction of ties.

It is previously known a tie of the type mentioned above, consisting of a straight piece of steel wire which in one end has welded to it a round washer and in the other end has welded to it a relatively short transverse pin. When placing the tie in the anchorage, the end of the tie having the washer is introduced through the slot of the anchorage, whereupon the tie is turned about 90° so that the washer is positioned transversally in the anchorage and can no longer be pulled out. One disadvantage of such ties is that when they are used to anchor a facing to a concrete wall, the grip of the ties in the anchorage can easily loosen when the facing, for instance due to different temperature expansion, moves with respect to the concrete wall. Another drawback is that it is not allowed to use such ties above a certain tensile load due to their welded construction.

A further drawback is that these ties are relatively expensive to manufacture.

An object of the present invention is thus to provide an anchorage of the type first mentioned whose attachment in the concrete is so strong that its slot may be placed flush with the outside of the concrete in order to give simpler installation and avoid the use of wooden wedges in the concrete. Another object is to provide a tie which has a more secure grip in the anchorage and which may not be twisted out of position. A further object of the invention is to provide an anchorage/tie combination which permits relative movement between the facing and concrete wall without losing its strength.

These objects are obtained according to the invention with an anchorage of the type first mentioned which is characterized in that the section, at the opposite side of the longitudinal slot, is provided with external attachment flanges. The tie according to the invention is characterized in that its generally circular portion is constituted by a loop of the steel wire, and that the free end of the steel wire at the loop is bent transversally of the plane of the loop and extends some distance out from the loop.

Further advantageous features of the invention will appear from the dependent claims and from the following description of the examplifying embodiments of the invention which are shown in the accompanying drawing.

Figure 1:
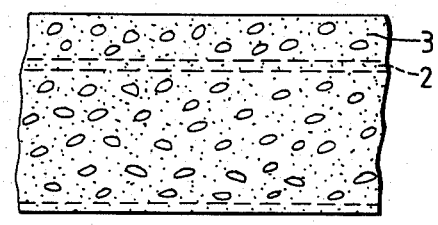
FIG. 1 illustrates a section through a concrete structure with an anchorage according to the invention embedded therein.
Figure 2:
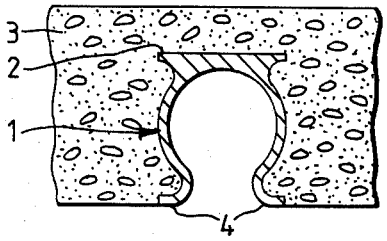
FIG. 2 shows a section transversally of the section shown in FIG. 1.

In FIGS. 1 and 2 the reference 1 denotes a metal section which is provided with external attachment flanges 2 giving good security against the section being pulled out of a wall, a ceiling or a floor 3 of concrete. On the opposite side of the attachment flanges 2 the section 1 is provided with a longitudinal slot, the edge portions 4 of which are curved outwardly so that their end portions extend substantially tangentially with respect to the profile. The edge portions 4 provide suitable and steady abutment of the section against the form during casting. Also the attachment flanges 2 extend substantially tangentially with respect to the profile and form together a plane outer surface which is well suited as abutment surface in those cases where the section is attached to the outside of the wall, for instance by means of screws in the cavity of the section. The section 1 may advantageously, in a manner known per se, be made of extruded aluminum. Thus, it may be manufactured in a simple and inexpensive manner and concurrently provide the necessary strength and durability.

Figure 3:
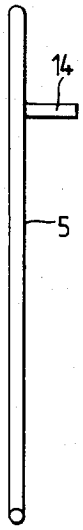
FIG. 3 shows a tie according to the invention in side view.
Figure 4:
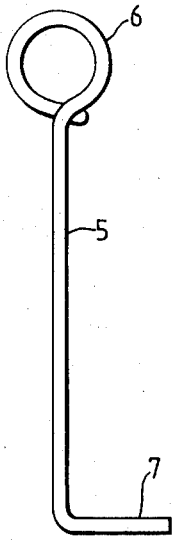
FIG. 4 shows the tie of FIG. 3 as viewed towards the left.

In FIGS. 3 and 4 a tie is shown which fits together with the section 1. The tie may consist of cold drawn stainless steel wire having a diameter of 4 mm and has been tested by the Norwegian Institute of Building Research to provide an extraction strength according to Norwegian Standard 3473 of 252.31 kp, while the required design extraction strength is 229.4 kp. The tie is at one end provided with an eye 6 consisting of a loop of the steel wire. At the loop the free end 14 of the steel wire is bent transversely of the plane of the loop and extends some distance out from the loop. At its other end the steel wire has a transverse portion 7 for attachment to the object the tie and anchorage are to anchor.

By installation of the tie 5 its eye 6 is entered obliquely into the cavity of the section 1 until the free end 14 of the eye abuts against one of the edge portions 4 of the slot of the section. Thereafter the tie is twisted about 90° so that the eye 6 will fill the cross section of the section and the free end 14 of the eye will be situated in the slot of the section parallel therewith. The tie is then pivoted so that its stem portion extends generally perpendicularly to the section and the structure 3. In this position the tie cannot be twisted so that the eye 6 loses its grip in the section because the free end 14 will abut against the walls of the slot.

Figure 7:
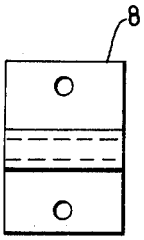
FIG. 7 shows a plan view of a safeguarding plate for a tie according to FIGS. 3 and 4.
Figure 8:
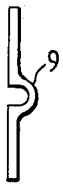
FIG. 8 shows the safeguarding plate of FIG. 7 in side view.

The other transverse end portion 7 of the tie is suited for embedding i.a. in a facing, or it can be attached by means of a safeguarding plate 8 having a cavity formed by a rounded ridge 9, as shown in FIGS. 7 and 8. The safeguarding plate 8 may be attached to the object to be anchored by the anchorage and the tie and thus form a further safeguard against the eye 6 of the tie being twisted out of its locking position in the section 1.

Figure 5:
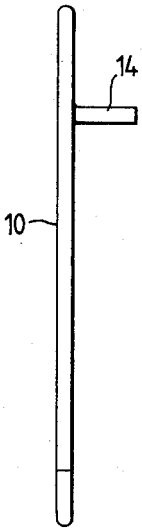
FIG. 5 is a view like FIG. 3 and shows a modification of the tie.
Figure 6:
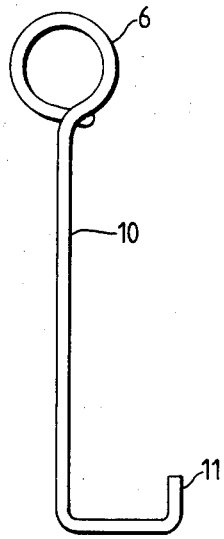
FIG. 6 shows the tie of FIG. 5 as viewed towards the left.
Figure 9:
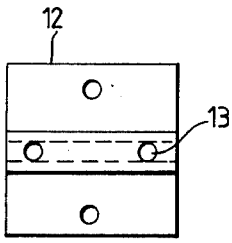
FIG. 9 shows a plan view of a safeguarding plate for the tie of FIGS. 5 and 6.
Figure 10:
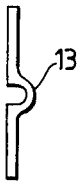
FIG. 10 shows the safeguarding plate of FIG. 9 in side view.

In the examplifying embodiment of the tie shown in FIGS. 5 and 6 the transverse portion is provided with a free end portion 11 which is bent to generally parallelity with the stem portion of the tie. This tie is intended for cooperation with the special safeguarding plate shown in FIGS. 9 and 10. It will be noted that this plate has two holes 13 in the rounded ridge and that the distance between these two holes correspond to the distance between the stem portion and the end portion 11 of the tie. The safeguarding plate 12 may thus be threaded on to the end portion of the tie and be locked during loading. Such a safeguarding plate is very well suited as support for false ceiling plates to be supported below a ceiling by means of the tie end anchorage according to the invention. Even by greater relative movements between the falls ceiling and the ceiling the tie cannot be twisted out of the anchorage or displaced out of the safeguarding plate.

I claim:

1. An anchorage for attachment of ties to walls, floors, ceilings or the like, the anchorage comprising; a substantially circular tubular section having a longitudinally extending slot for the introduction of one end of the tie, the section having external attachment flanges extending tangentially with respect to the section on the side thereof opposite from the slot, and said flanges also extending longitudinally along the section, the flanges thus forming an external abutment surface on the tubular section and said section being made of extruded aluminum.

2. An anchorage according to claim 1, characterized in that the edge portions (4) of the slot are curved outwardly so that their end portions extend substantially tangentially with respect to the section (1).

3. A tie for attachment in an anchorage comprising a substantially circular tubular section having a longitudinal slot for the introduction of one end of the tie, said tie being formed generally of steel wire and having an intermediate, straight stem portion which, at one end, has a substantially circular loop portion having a diameter substantially equal to the internal diameter of the section, the free end of said substantially circular loop being bent transversely of the plane of the loop and extending some distance out from that plane.

4. A tie according to claim 3, wherein the end of the stem opposite from the loop portion has a transverse portion extending transverse to the stem.

5. A tie according to claim 4, wherein the transverse portion has a free end which is bent generally parallel with the stem portion.

6. A tie according to claim 3 or 4, including a plate-like piece having means for cooperating with the tie for being threaded onto the transverse portion thereof.

7. In combination, an anchorage for attachment of ties to walls and a tie for attachment to said anchorage, the anchorage comprising; a substantially circular tubular section having a longitudinally extending slot for the introduction of one end of the tie, the section having external attachment flanges extending tangentially with respect to the section on the side thereof opposite from the slot, and said flanges also extending longitudinally along the section, the flanges thus forming an external abutment surface on the tubular section and said section being made of extended aluminum, the tie being formed of steel wire and having an intermediate, straight stem portion which, at one end, has a substantially circular loop portion having a diameter substantially equal to the internal diameter of the section, the free end of said substantially circular loop portion being bent transversely of the plane of the loop and extending some distance out from that plane.

* * * * *